United States Patent [19]

Andersson

[11] Patent Number: 4,947,182

[45] Date of Patent: Aug. 7, 1990

[54] METHOD OF FEEDING ELECTROMAGNETIC POWER FROM AN ANTENNA ELEMENT

[75] Inventor: Mats R. Andersson, Gothenburg, Sweden

[73] Assignee: Telefonaktiebolaget L M Ericsson, Stockholm, Sweden

[21] Appl. No.: 375,595

[22] Filed: Jul. 5, 1989

[30] Foreign Application Priority Data

Sep. 27, 1988 [SE] Sweden ..... 8803418

[51] Int. Cl.[5] ..... H01Q 3/24; H01Q 1/28

[52] U.S. Cl. ..... 343/876; 342/361; 343/705; 343/756

[58] Field of Search ..... 343/756, 789, 829, 846, 343/876, 705, 778; 342/361

[56] References Cited

U.S. PATENT DOCUMENTS 3,215,957 11/1965 Dantzig et al. ..... 343/756

3,938,158 2/1976 Birch et al. ..... 333/21 R 4,051,474 9/1977 Mack et al. ..... 343/756

FOREIGN PATENT DOCUMENTS 0291233 11/1988 European Pat. Off. ..... 343/789

*Primary Examiner*—Michael C. Wimer

*Attorney, Agent, or Firm*—Burns, Doane, Swecker & Mathis

[57] ABSTRACT

A method of feeding out field power from a circularly polarized antenna (2), mounted on a conductive aircraft surface (1). All power is normally fed out in circular polarization to the receiver, irrespective of the elevation angle ($\theta$) and the azimuth angle ($\alpha$). For increasing the antenna amplification at elevation angles $\theta$ greater than or approximately equal to 60°, where substantially only the vertical polarization can be seen, it is proposed in accordance with the method that all power is fed out in linear polarization with the aid of a polarization switch (4).

2 Claims, 2 Drawing Sheets

METHOD OF FEEDING ELECTROMAGNETIC POWER FROM AN ANTENNA ELEMENT

The present invention relates to a method of feeding out electromagnetic power in an antenna element or an antenna array including a plurality of antenna elements. The method is primarily intended to be utilized in antenna elements mounted on the surface of an airborne vechicle satellite.

BACKGROUND ART

Communication from an aircraft to a satellite or between satellites requires circularly polarized antennas, i.e. antennas which transit circularly polarized radiation, and which have a very wide covering area. If the antenna must be mounted on the surface of the aircraft or the satellite, due to aerodynamic requirements, only limited coverage can be achieved by circular polarization, as described, e.g., by R. J. Mailloux "Phased array aircarft antennas for satellite communications", Microwave Journal Oct. 1977, p. 38. The reason is that circular polarization can be regarded as a combination of a vertical and a horizontall polarization with 90° phase shift. If the antenna is mounted on the surface of the vehicle, the horizontal polarization component of the field, which is thus parallel to the surface of the vehicle, will be short-circuited while the vertical polarization component at right angles to the surface is only decreased or attenuated by a certain amount (approximately 3.2 dB). Hereinafter, a horizontal and a vertical polarization component are respectively defined as components parallel and perpendicular to an electrically conductive surface (the surface of the vehicle). The loss in a circular-polarized antenna outside the vehicle will be a further 6 dB, however, of which 3 dB is because only vertical polarization can be seen, and a further 3 dB in the feed network, since both polarization components are fed.

DISCLOSURE OF INVENTION

The object of the present invention is to increase the transmitting power of an antenna mounted on the surface of an airborne vehicle which is fed with circular polarization and for different reception angles in the elevation direction.

This is achieved in accordance with the proposed method by changing the polarization in the field that is fed out from the antenna in response to the direction the receiver is in, in relation to the feed plane (the surface of the vehicle) of the antenna. The method is characterised as disclosed in the characterising portion of claim 1.

BRIEF DESCRIPTION OF DRAWINGS

The invention will now be described in more detail with reference to the accompanying drawings, where.

BEST MODE FOR CARRYING OUT THE INVENTION

Figure 1:
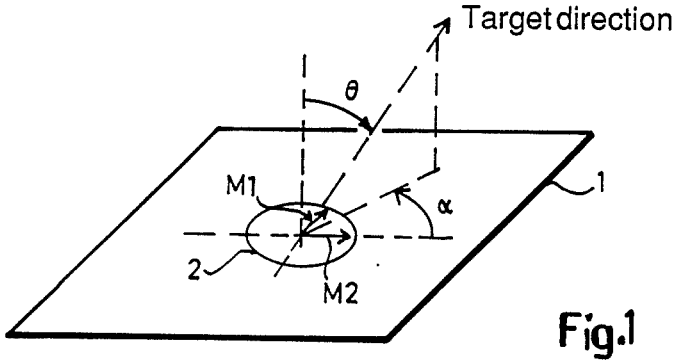
FIG. 1 illustrates part of an aircraft surface with an antenna element.

In FIG. 1, there is illustrated an aircraft surface 1, on which an antenna element is disposed. The antenna element can receive or transmit a field with two feed polarizations, the components of which are denoted M1 and M2, where M1 is perpendicular to M2, although both are in the same horizontal plane. The feed field from the antenna waveguide is circularly polarized in this case, and the planes of both components are in the same plane as that of the aircraft surface 1.

Figure 2:
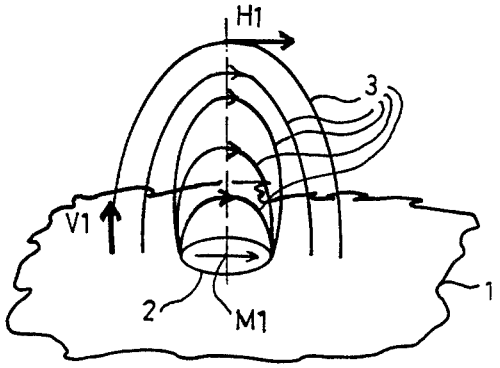
FIG. 2 is a simplified depiction of the field from a feed polarization for the antenna element in FIG. 1, using linear polarization.

FIG. 2 is a depiction of the field about a feed polarization component M1. This gives rise to a field about the antenna element 2 which contains a vertical polarization V1 and a horizontal polarization H1. The field is here linearly polarized.

Figure 3:
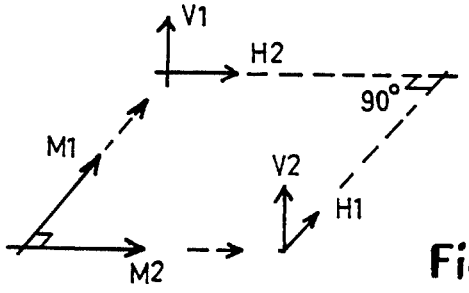
FIG. 3 illustrates how two (linear) polarizations are divided into their components in circular feed polarization.

FIG. 3 illustrates the two feed polarizations M1 and M2, which according to FIG. 2 each can be divided into a vertical and a horizontal polarization component. A circularly polarized feed field can thus be regarded conventionally as two orthogonal polarizations V1, H1 and V2, H2, where the H component is phase-shifted 90° in relation to the V component. Each of the polarizations M1 and M2 can resolve into linearly vertical or horizontal polarization depending on from what azimuth angle $\alpha$ they are observed. The angle of elevation for transmitting to different receivers is denoted by $\theta$ in FIG. 1. It is obvious that for large elevation angles $\theta$ the components H1 and H2 will be short-circuited in the conductive aircraft surface 1.

In accordance with the invention, it is therefore proposed that all power is fed out solely in linear polarization V1, H1 or V2, H2 when the receiver is in elevation angles $\theta$ greater than a given value $\theta_o$, while for $\theta<\theta_o$, the feed-out takes place in circular polarization. The value of $\theta_o$ is selected as will be apparent from the graph according to FIG. 5. Since, according to the above, the vertical or the horizontal component will dominate, in response to which azmith angle $\alpha$ is observed, the selection of vertical or horizontal polarization will be dependent on the value of $\alpha$.

Figure 4:
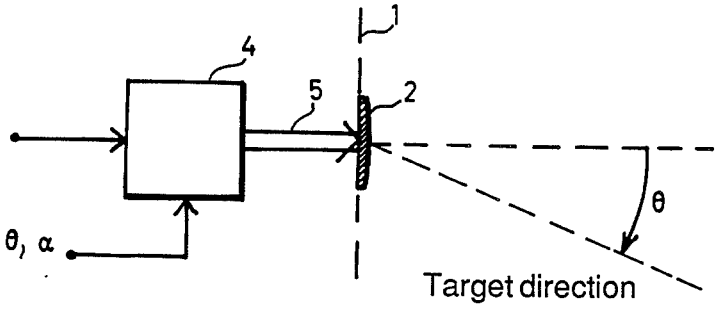
FIG. 4 is a simplified block diagram of an antenna feed carrying out the method in accordance with the invention.

FIG. 4 is simplified block diagram of an antenna feed for carrying out the method in accordance with the invention. It comprises a switch means 4, which receives an incoming microwave signal, which is to be fed out to the antenna element 2 and be transmitted to a given receiver. The switch means 4 is controlled by a signal giving the values of the angles $\theta$, $\alpha$ applying to the receiver in question, and according to the conditions set out above. The switch means 4 may comprise, for example, a circular wave conductor, two switches and a power divider. The circular wave conductor is provided with two probes which are inserted in the wave conductor wall, one probe being displaced at 90° to the the other. The power divider can divide the incoming microwave signal into two waves of equal power when it is switched into the circuit.

If $\theta<\theta_o$, the power divider is switched in and both components M1, M2 are fed out, but with the phase difference 90°, which gives a circularly polarized field.

If $\theta>\theta_o$, the power divider is switched out of the circuit and the input signal is either connected to one or the other probes depending on the value of the azimuth angle $\alpha$, which applies to the receiver in question (as will be seen from below). Either M1 or M2 is fed out in response to the azimuth angle $\alpha$, and a lineary polarized field is obtained.

The waveguide 5 can comprise, for example, an extension of the circular waveguide included in the switch means 4. The following table states within which azimuth angle interval the different feeds are used:

| Angular interval $\Theta$ | Angular interval $\alpha$ | Feed component polarizaton |
|---|---|---|
| $\Theta < 60°$ | Immaterial | M1, M2 190° circular |
| $\Theta > 60°$ | $45° < \alpha < 135°$<br>$225° < \alpha < 305°$ | M1 linear |
| $\Theta > 60°$ | $305° < \alpha < 360°; 0 < \alpha < 45°$<br>$135° < \alpha < 225°$ | M2 linear |

The above values of $\alpha$ are, of course, repeated every 320°.

Figure 5:
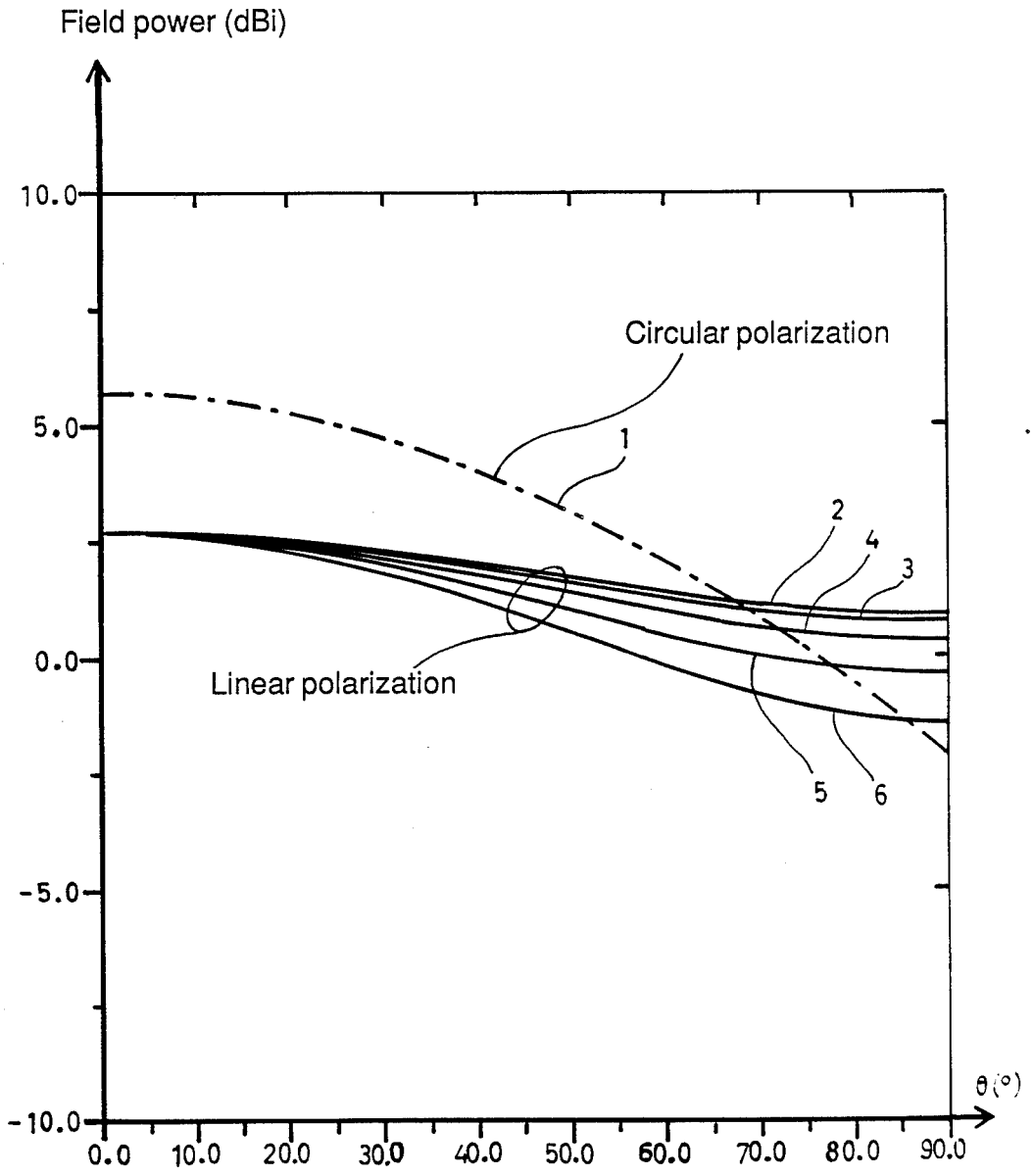
FIG. 5 is a graph of received power when the proposed method is utilized.

FIG. 5 is a simplified directivity graph for the circularly polarized field, graph 1, and for five different linearly polarized fields, graphs 2, 3, 4, 5 and 6, where the latter are dependent on ten different values of the azimuth angle $\alpha$, according to the following:

Graph 1: Coverage by circular polarization irrespective of the value of $\alpha$, Graph 2: Coverage with linear polarization for $\alpha=0$, $\alpha=90°$, Graph 3: Coverage with linear polarization for $\alpha=10°$, $\alpha=\lambda°$, Graph 4: Coverage with linear polarization for $\alpha=20°$, $\alpha=70°$, Graph 5: Coverage with linear polarization for $\alpha=30°$, $\alpha=60°$, Graph 6: Coverage with linear polarization for $\alpha=40°$, $\alpha=50°$.

From the graphs according to FIG. 5, it will be seen that the graph 1 intersects the graphs 2–6 at certain points where $\theta=\theta_o$ and for different values of the azimuth of the azimuth angle $\alpha$. Directivity gains can be obtained at these points if there is a change from circular to linear polarization.

When a receiver is at an elevation angle $\theta<\theta_o(\alpha)$, the antenna power is fed out with circular polarization, i.e. V1=H2 $\underline{|90°}$, V2=H1 $\underline{|90°}$. When $\theta=\theta_o(\alpha)$ switching over takes place as descibed above in connection with FIG. 4, and all power is fed in linear polarization, i.e. M1=0 or M2=0. In this way, antenna amplification can be increased by up to 3 dB for receivers in elevation angles close to the horizon, ($\theta=90°$). According to FIG. 5, the greatest gain is obtained when $\theta=90°$, $\alpha=0$ or 90°, namely 3 dB. For other $\theta-$ and $\alpha-$ angles, when $\theta\geqq$ or approximately equal to 65°, the directivity gain varies between 0 to 3 dB according to FIG. 5.

I claim:

1. Method of selecting the polarization mode of an electromagnetic field transmitted from an antenna element, (2), which is arranged on a planar electrically conductive surface, out of a linear polarization mode constituted either by a first polarization component (M1) or a second polarization component (M2), said first and second components being perpendicular to each other and parallel to said planar surface, and a circular polarization mode constituted by said first and second polarization components (M1, M2) together, the direction of said electromagnetic field having a certain elevational angle ($\theta$) measured from a line perpendicular to said planar surface and an azimuth angle ($\alpha$) measured from a fixed reference line on said surface, comprising the steps of:

(a) selecting said circular polarization mode for the transmitted field from said antenna element when the elevational angle ($\theta$) of said direction is less than a given angle ($\theta_o$), and (b) selecting said linear polarization mode for the transmitted field from said antenna element when said elevational angle ($\theta$) is greater than said given angle.

2. Method as claimed in claim 1, wherein said circular polarization mode for the transmitted field is selected when the elevational angle ($\theta$) of said direction is less than said given angle ($\theta_o$) irrespective of the value of said azimuth angle ($\alpha$) and said linear polarization mode is selected when the elevational angle ($\theta$) of said direction is greater than said given angle and constituted by said first polarization component (M1) for a first and a third azimuth angular interval and by said second polarization component (M2) for a second and a fourth azimuth angular interval, said first, second, third and fourth angular intervals being successive parts of a complete revolution around said antenna element.

* * * * *